US005962797A

United States Patent [19]

Spercel et al.

[11] Patent Number: 5,962,797

[45] Date of Patent: Oct. 5, 1999

[54] MUSICAL INSTRUMENT

[76] Inventors: Ronald R. Spercel, 6135 Winding Creek La., North Olmstead, Ohio 44070; Robert J. Sperzel, 12520 Edgewater Dr., Lakewood, Ohio 44107

[21] Appl. No.: 08/962,990

[22] Filed: Oct. 31, 1997

[51] Int. Cl.[6] ..... G10D 3/00

[52] U.S. Cl. ..... 84/297 R; 84/267

[58] Field of Search ..... 84/297 R, 304, 84/293, 267

[56] References Cited

U.S. PATENT DOCUMENTS

| | | | |
|---|---|---|---|
| 3,443,018 | 5/1969 | Krebs | 84/741 |
| 3,769,871 | 11/1973 | Cawthorn | 84/291 |
| 4,248,127 | 2/1981 | Lieber | 84/314 N |
| 4,625,614 | 12/1986 | Spercel | 84/306 |
| 4,735,124 | 4/1988 | Bernier | 84/304 |
| 5,175,387 | 12/1992 | Greory | 84/267 |
| 5,212,329 | 5/1993 | Woodworth | 84/263 |
| 5,539,144 | 7/1996 | Sherman | 84/313 |

FOREIGN PATENT DOCUMENTS 340568 9/1921 Germany .

*Primary Examiner*—Robert E. Nappi
*Assistant Examiner*—Shih-yung Hsieh
*Attorney, Agent, or Firm*—Tarolli, Sundheim, Covell, Tummino & Szabo

[57] ABSTRACT

An improved musical instrument includes a plurality of strings which are connected string posts of tuning devices on a head portion of the musical instrument. The string posts of the tuning devices are disposed in a linear array on the head portion of the musical instrument. A linear edge of the head portion extends parallel to a plane containing the central axes of the string posts in the linear array. In addition, the head portion has a nonlinear edge with arcuate recesses. Actuators for some of the tuning devices are movable in the recesses along the nonlinear edge during manual rotation of the actuators. Actuators for some of the tuning devices are disposed along the linear edge. At least some of the actuators along the nonlinear edge are longer than actuators along the linear edge.

4 Claims, 5 Drawing Sheets

MUSICAL INSTRUMENT

BACKGROUND OF THE INVENTION

The present invention relates to a new and improved musical instrument and more specifically to a musical instrument of the guitar or banjo type.

Musical instruments of the guitar or banjo type may have a neck portion which extends outward from a body portion to a head portion. Strings have one end connected with the body portion of the instrument. The opposite ends of the strings are connected with tuning devices on the head portion of the instrument. The tuning devices on the head portion of the instrument may have string posts disposed in a linear array. One known musical instrument having this general construction is disclosed in U.S. Pat. No. 5,539,144. Other known musical devices of the this general construction are disclosed in U.S. Pat. Nos. 3,769,871 and 4,735,124 and in German Patentschrift No. 340,568.

SUMMARY OF THE INVENTION

The present invention provides a new and improved musical instrument having a neck portion which extends from a body portion to a head portion. Strings extend along the neck portion to tuning devices on the head portion. The tuning devices on the head portion have string posts disposed in a linear array.

The head portion of the musical instrument may have a linear edge portion and a nonlinear edge portion. Some of the tuning devices have manually rotatable knobs disposed adjacent to the linear edge portion. Other tuning devices have manually rotatable knobs disposed adjacent to the nonlinear edge portion.

The nonlinear edge portion may have recesses through which some of the knobs move to facilitate manual engagement of the knobs. Some of the actuators associated with tuning devices adjacent to the nonlinear edge portion may have a length which is greater than the length of the actuators associated with tuning devices adjacent to the linear edge portion.

BRIEF DESCRIPTION OF THE DRAWINGS

The foregoing and other features of the invention will become more apparent more upon a consideration of the following description taken in connection with the accompanying drawings wherein.

DESCRIPTION OF ONE SPECIFIC PREFERRED EMBODIMENT OF THE INVENTION

General Description

Figure 1:
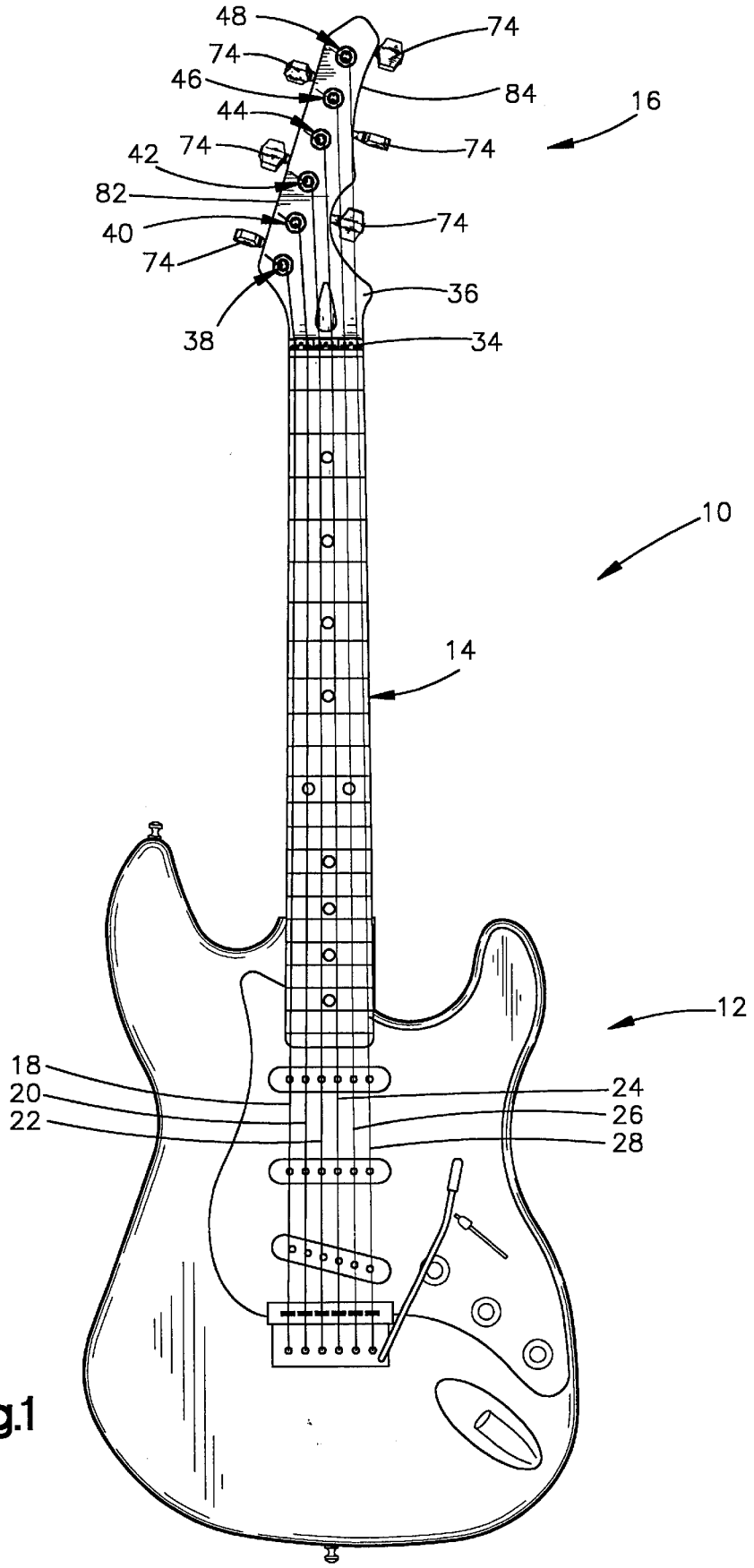
FIG. 1 is a front elevational view of a musical instrument constructed in accordance with the present invention.

A musical instrument 10 (FIG. 1) includes a body portion 12 having a well known construction. A neck portion 14 extends outward from the body portion 12 to a head portion 16. A plurality of strings 18, 20, 22, 24, 26 and 28 extend from the body portion 12 along the neck portion 14 to the head portion 16.

Figure 4:
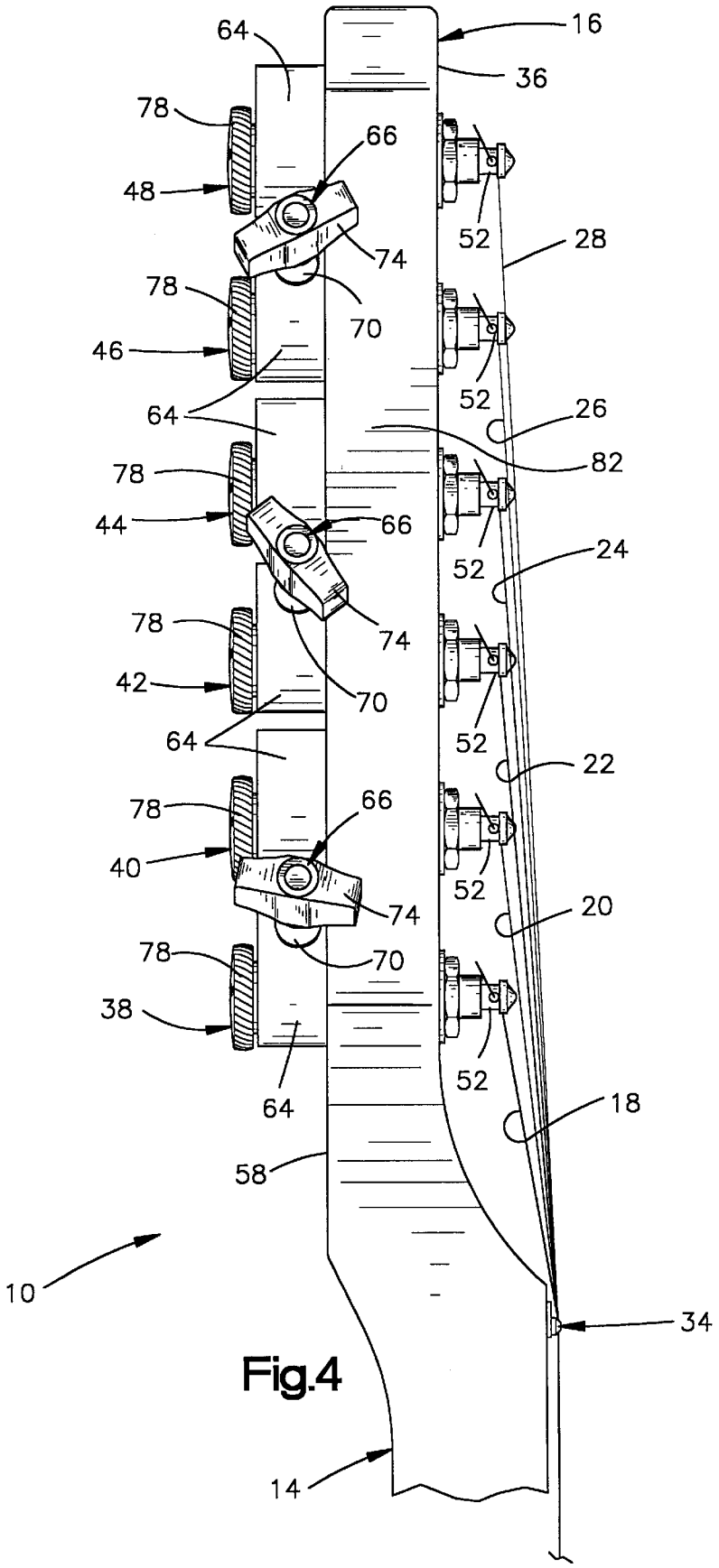
FIG. 4 is a side elevational view, taken generally along the line 4—4 of FIG. 2, further illustrating the relationship of the tuning devices to the head portion.
Figure 5:
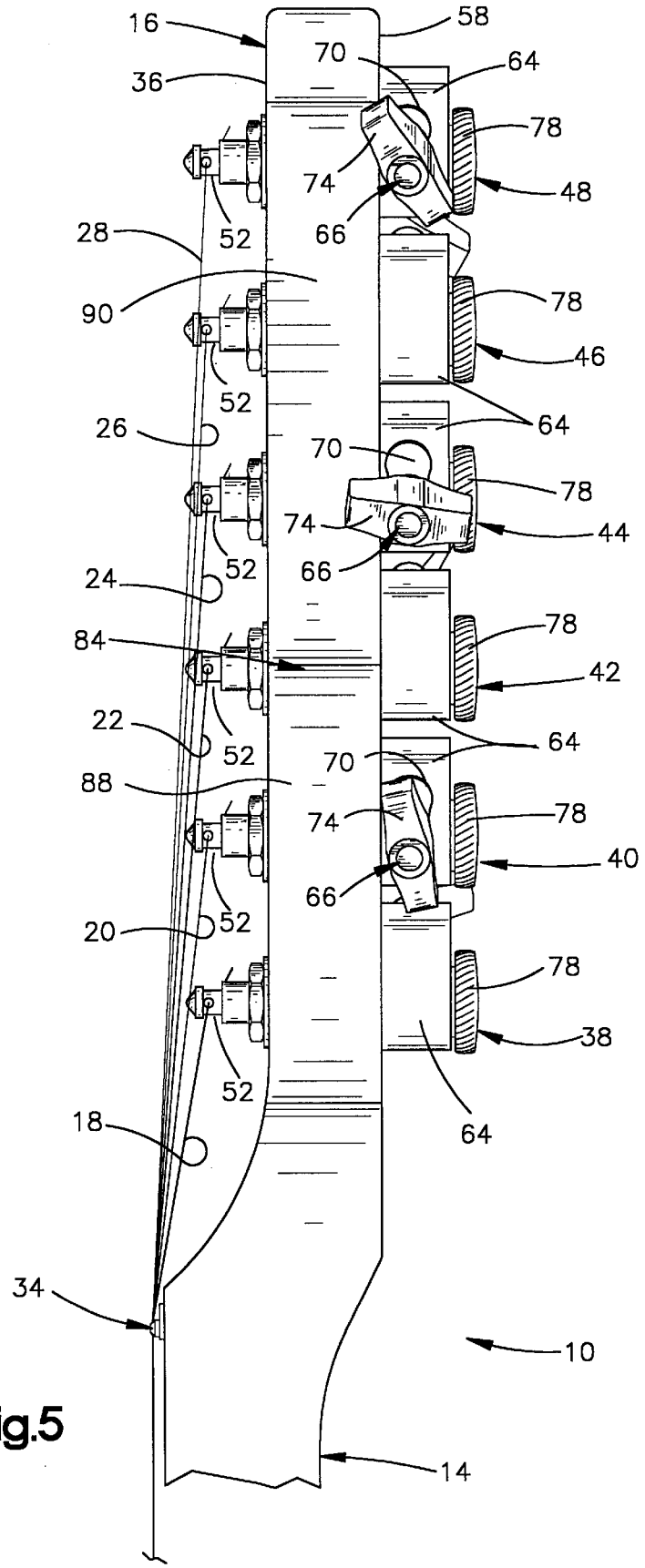
FIG. 5 is a side elevational view, taken generally along the line 5—5 of FIG. 2, further illustrating the relationship of the tuning devices to the head portion.

The strings 18–28 are straight and parallel to each other along the neck portion 14. They extend from the neck portion 14 across a string support 34 to the head portion 16. At the string support 34, the strings are deflected toward a flat front side surface 36 on the head portion 16 (FIGS. 4 and 5). The string support has the same construction as is disclosed in U.S. Pat. No. 5,492,044 issued Feb. 20, 1996 and entitled "String Support Having a Base With String Support Members and Method".

At the head portion 16, each of the strings 18–28 is connected with a tuning device of a plurality of tuning devices mounted on the head portion 16. Thus, the string 18 is connected with a tuning device 38 (FIGS. 2, 3, 4 and 5). The string 20 is connected with a tuning device 40. The string 22 is connected with a tuning device 42. Similarly, the string 24 is connected with a tuning device 44. The string 26 is connected with a tuning device 46. The string 28 is connected with a tuning device 48.

Figure 2:
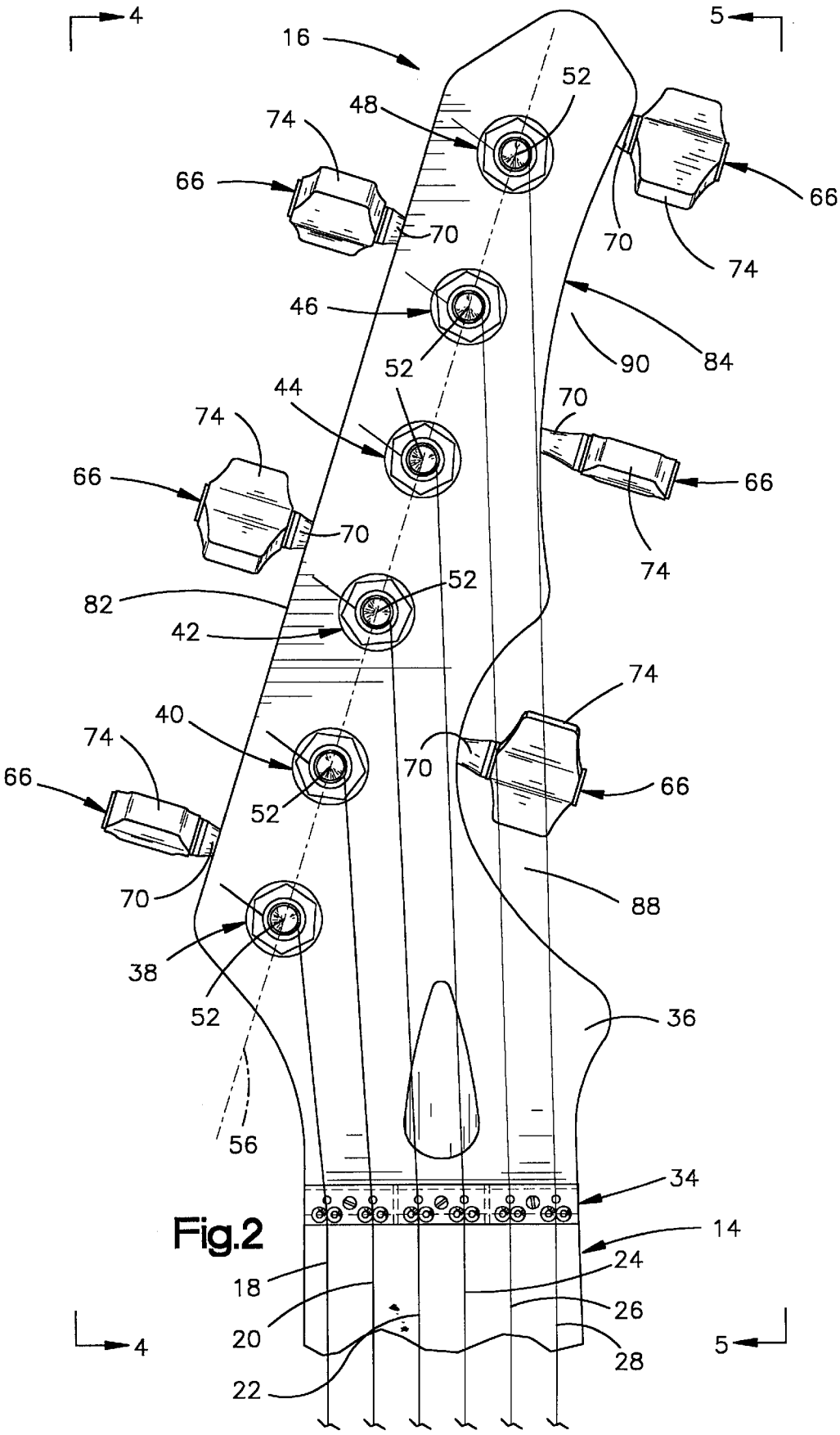
FIG. 2 is an enlarged view of a head portion of the musical instrument of FIG. 1 and illustrating the relationship of a plurality of tuning devices to the head portion.

Each of the tuning devices 38–48 includes a generally cylindrical string post 52 (FIGS. 2, 4 and 5). The string posts 52 extend through the head portion 16 of the musical instrument 10. The string posts 52 have parallel central axes disposed in a linear array. The central axis of each of the string posts 52 is disposed in a plane 56 (FIG. 2). The plane 56 extends perpendicular to parallel front and rear side surfaces 36 and 58 (FIGS. 2, 3, 4 and 5) of the head portion 16.

The parallel central axes of the string posts 52 extend perpendicular to parallel front and rear side surfaces 36 and 58 of the head portion 16. The string posts 52 are spaced equal distances apart in a linear array on the head portion 16 of the musical instrument 10. The string posts 52 are aligned with connections of the strings 18–28 with the body portion 12 (FIG. 1) of the musical instrument 10. Therefore, the strings 18–28 are disposed in parallel planes. By having the strings 18–28 disposed in parallel planes, tensioning of the strings by operation of the tuning devices 38–48 is facilitated.

Figure 3:
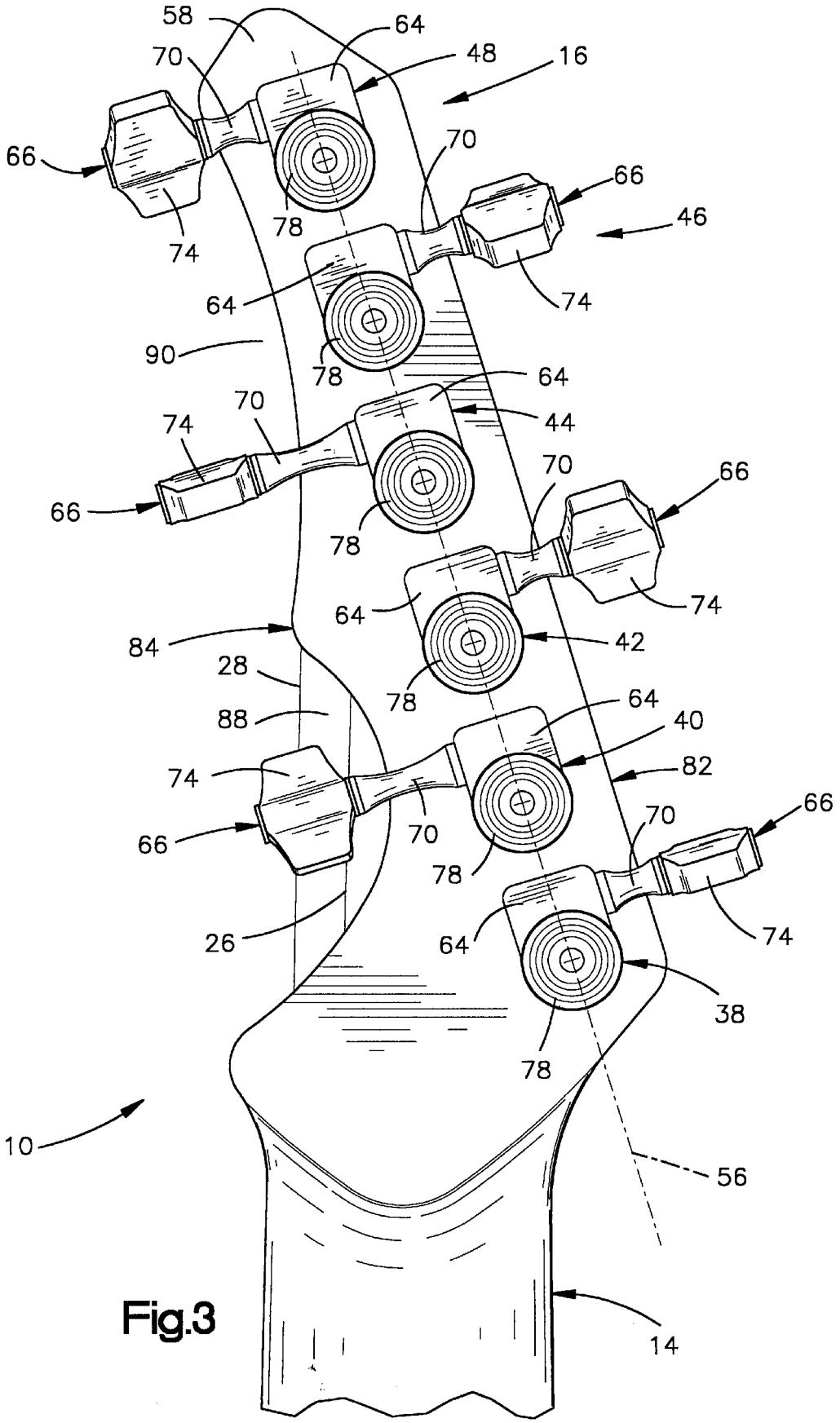
FIG. 3 is a rear elevational view further illustrating the relationship of the tuning devices to the head portion of the musical instrument of FIG. 1.

Each of the tuning devices 38–48 includes a housing 64 (FIG. 3). In addition, each of the tuning devices 38–48 includes an actuator 66. The actuators 66 are manually rotatable to rotate the string posts 52 about their central axes to adjust tension in the strings 18–28.

Each of the actuators 66 includes an actuator shaft 70. Each of the actuator shafts 70 is connected with a worm (not shown) disposed in the housing 64. The worm connected with each actuator shaft 70 engages a pinion (not shown) which is fixedly connected with a string post 52. The actuator shafts 70 and worms connected therewith have central axes extending perpendicular to the plane 56. The housings 64 enclose the worms connected with the actuator shafts 70 and the pinions connected with the string posts 52.

The actuators 66 include knobs 74 (FIG. 3) which are fixedly connected to the actuator shafts 70. The tuning devices 38–48 are of the locking type and have locking knobs 78 (FIGS. 4 and 5) which are manually rotatable to move a pin (not shown) in a string post 52 to lock one of the strings 18–28 against movement relative to the string post. The tuning devices 38–48 have the same construction as is disclosed in U.S. Pat. No. 4,625,614 issued Dec. 2, 1986 and entitled "Tuning Device". However, if desired, the tuning devices 38–48 could have the same construction as is disclosed in U.S. Pat. No. 4,353,280 issued Oct. 12, 1982 and entitled "Tuning Device". Of course, the tuning devices 38–48 could have other known constructions if desired.

Head Portion—Configuration

In accordance with a feature of the present invention, the head portion 16 has a linear edge portion 82 and a nonlinear edge portion 84 (FIGS. 2 and 3). The linear and nonlinear edge portions 82 and 84 extend between the front side surface 36 and rear side surface 58 (FIGS. 4 and 5) of the head portion 16. The linear and nonlinear edge portions 82 and 84 have a length equal to the length of the linear array of string posts 52 for the tuning devices 38–48.

The linear edge portion 82 (FIGS. 2 and 3) extends parallel to the plane 56 containing the central axes of the string posts 52. The actuator shafts 70 of the tuning devices 38, 42 and 46 extend perpendicular to the linear edge portion 82. The actuator knobs 74 for the tuning devices 38, 42 and 46 are disposed in a linear array along the nonlinear edge portion 82. Each of the actuator shafts 70 for the tuning devices 38, 42 and 46 has the same length. Therefore, the actuator knobs 74 for the tuning devices 38, 42 and 46 are disposed the same distance from the linear edge portion 82.

The nonlinear edge portion 84 has an arcuately curving configuration. The arcuately curving configuration of the nonlinear edge portion 84 defines a pair of arcuate recesses 88 and 90 (FIGS. 2 and 3). The strings 26 and 28 span the arcuate recess 88. This enables the strings 26 and 28 to be plucked at the arcuate recess 88 to provide special effects during playing of the musical instrument 10.

The actuator knobs 74 for the tuning devices 40, 44 and 48 are disposed adjacent to the recesses 88 and 90. During rotation of the actuator knob 74 for the tuning devices 40, 44 and 48, the actuator knobs move in the recesses 88 or 90. Thus, during rotation of the actuator knob 74 to operate the tuning device 40 to vary the tension in the string 20 (FIG. 2), the actuator knob moves in the arcuate recess 88. Similarly, during manual rotation of the actuator knob 74 for either the tuning device 44 or 48 to vary the tension in the string 24 or 28, the actuator knob moves in the arcuate recess 90.

Tuning Device Orientation

In accordance with a feature of the present invention, the actuators 66 for adjacent tuning devices 38–48 extend in opposite directions from the linear array of string posts (FIGS. 1 and 2). Thus, the actuators 66 (FIGS. 2 and 3) for the tuning devices 38, 42 and 46 extend across the linear edge portion 82. The actuators 66 for the tuning devices 40, 44 and 48 extend across the nonlinear edge portion 84.

By having the actuators 66 for the tuning devices 38, 42, and 46 extend in a direction opposite from the actuators 66 for the tuning devices 40, 44, and 48, spacing between the actuator knobs 74 for the tuning devices 38–48 is maximized (FIGS. 1–5). This provides room for engagement of any one of the actuator knobs 66 by the hand of a person playing the instrument 20. If the actuators 66 all extended in the same direction from the tuning devices 38–48, there would be half as much spacing between the actuator knobs 74 for the tuning devices. The relatively large spaces provided between the actuator knobs 74 of the tuning devices 38–48 of FIGS. 1 and 2 enables a musician to rotate any one of the knobs without engaging an adjacent knob and accidentally changing the tension for an associated string.

Different Length Actuators

In accordance with another feature of the present invention, the actuators 66 for the tuning devices 40 and 44 (FIG. 3) are longer than the actuators for the tuning devices 38, 42, 46 and 48. The relatively long length of the actuators 66 for the tuning devices 40 and 44 enables the actuator knobs 74 for these tuning devices to be disposed in the arcuate recesses 88 and 90 during rotation of the actuator knobs. In addition, the relatively long length of the actuators 66 for the tuning devices 40 and 44 enables the head portion 16 to project a substantial distance toward the left (as viewed in FIG. 3) from the plane 56 through the linear array of string posts 52 (FIG. 2). This enables the material of the head portion (wood) to have sufficient rigidity to support the tuning devices 38–48.

In the illustrated embodiment of the invention, the actuators 66 for the tuning devices 40 and 44 have the same length. However, it is contemplated that it may be desired to construct the actuators 66 for the tuning devices 40 and 44 with different lengths. Thus, the actuator 66 for the tuning device 40 could be longer than the actuator 66 for the tuning device 44. In the embodiment of the invention illustrated in FIG. 3, the actuator 66 for the tuning device 48 has the same length as the actuators 66 for the tuning devices 38, 42 and 46. However, it is contemplated that the actuator 66 for the tuning device 48 could be longer than the actuators 66 for the tuning devices 38, 42 and 46 if desired.

Conclusion

In view of the foregoing description, it is apparent that the present invention provides a new and improved musical instrument 10 having a neck portion 14 which extends from a body portion 12 to a head portion 16. Strings 18–28 extend along the neck portion to tuning devices 38–48 on the head portion 16. The tuning devices 38–48 on the head portion 16 have string posts 52 disposed in a linear array.

The head portion 14 of the musical instrument 10 may have a linear edge portion 82 and a nonlinear edge portion 84. The tuning devices 38, 42 and 46 have manually rotatable knobs 74 disposed adjacent to the linear edge portion. The tuning devices 40, 44 and 48 have manually rotatable knobs disposed adjacent to the nonlinear edge portion 84.

The nonlinear edge portion 84 may have recesses 88 and 90 through which some of the knobs 74 move to facilitate manual engagement of the knobs 84. The actuators associated with tuning devices 40 and 42 adjacent to the nonlinear edge portion 84 have a length which is greater than the length of the actuators associated with tuning devices 38, 42 and 46 adjacent to the linear edge portion 82.

From the above description of the invention, those skilled in the art will perceive improvements, changes and modifications. Such improvements, changes and modifications within the skill of the art are intended to be covered by the appended claims.

Having described the invention, the following is claimed:

1. A musical instrument comprising a body portion, a neck portion connected with and extending from said body portion, a head portion connected with said neck portion, said head portion having a front side, a rear side, a linear edge portion which extends between said front and rear sides, and a nonlinear edge portion which extends between said front and rear sides, said nonlinear edge portion includes an arcuate recess with a center of curvature which is offset from said head portion in a direction away from said linear edge portion, a plurality of strings which are connected with said body portion and extend along neck portion to said head portion, at least one of said strings of said plurality of strings spans said arcuate recess, a plurality of string posts, each of said string posts being connected with one of said strings at a location adjacent to said front side of said head portion, each of said string posts having a central axis which extends transverse to said front and rear sides of said head portion, actuators which are connected with said string posts and are manually rotatable to rotate said string posts about the central axes of said string posts to adjust tension in said strings, a first plurality of said actuators extend in a first direction from a first group of said string posts and have manually engageable end portions disposed adjacent to said linear edge portion of said head portion and a second plurality of said actuators extend in a second direction from a second group of said string posts and have manually engageable end portions disposed adjacent to said nonlinear edge portion, said manually engageable end portion of at least one of said actuators of said second plurality of actuators being movable in said arcuate recess during rotation of said one actuator of said second plurality of actuators.

2. A musical instrument as set forth in claim 1 wherein said actuators of said first plurality of actuators have a first length, said one of said actuators of said second plurality of actuators has a second length which is greater than said first length.

3. A musical instrument as set forth in claim 1 wherein said string posts have parallel central axes and each of said actuators is rotatable about an axis which extends perpendicular to a central axis of one of said string posts.

4. A musical instrument as set forth in claim 1 wherein said central axes of said string are disposed in a plane which extends parallel to said linear edge portion of said head portion of said musical instrument.

* * * * *